US007240903B2

(12) United States Patent
Jacobs

(10) Patent No.: US 7,240,903 B2
(45) Date of Patent: Jul. 10, 2007

(54) GOLF BOARD GAME

(76) Inventor: Charles Jacobs, 132 104th La. NW., Coon Rapids, MN (US) 55448-5039

( * ) Notice: Subject to any disclaimer, the term of this patent is extended or adjusted under 35 U.S.C. 154(b) by 92 days.

(21) Appl. No.: 10/852,064

(22) Filed: May 24, 2004

(65) Prior Publication Data

US 2005/0258595 A1 Nov. 24, 2005

(51) Int. Cl.
*A63F 3/00* (2006.01)

(52) U.S. Cl. ..... 273/245; 273/259; 273/277

(58) Field of Classification Search ..... 273/245, 273/259, 277

See application file for complete search history.

(56) References Cited

U.S. PATENT DOCUMENTS

| | | | | |
|---|---|---|---|---|
| 3,658,339 | A | 4/1972 | Boileau | |
| 3,857,568 | A | 12/1974 | Yoder | |
| 3,944,229 | A | 3/1976 | Feeny | |
| 3,989,249 | A * | 11/1976 | Breslow | 273/108.2 |
| 4,042,246 | A | 8/1977 | Strandgard | |
| 4,093,233 | A * | 6/1978 | Barbarow | 473/173 |
| 4,106,774 | A | 8/1978 | Seguin | |
| 4,113,260 | A * | 9/1978 | Sain | 273/245 |
| 4,127,273 | A * | 11/1978 | Bonvetti, III | 273/245 |
| 4,277,065 | A | 7/1981 | White | |
| 4,809,985 | A | 3/1989 | Trimble | |
| 5,000,460 | A | 3/1991 | Barbiaux et al. | |
| 5,413,349 | A | 5/1995 | Canther | |
| 5,722,659 | A | 3/1998 | Gluth | |
| 5,924,693 | A | 7/1999 | Beaumier et al. | |
| 6,105,963 | A | 8/2000 | Dontfraid | |
| 6,457,713 | B1 | 10/2002 | Oppenheimer et al. | |
| 2002/0105140 | A1 | 8/2002 | Field | |
| 2003/0006552 | A1 | 1/2003 | Barry | |
| 2003/0025269 | A1 | 2/2003 | Stranger | |

* cited by examiner

*Primary Examiner*—Vishu Mendiratta
(74) *Attorney, Agent, or Firm*—N Paul Friederichs

(57) ABSTRACT

A method of playing a board game including each player selecting a peg; determining the number of holes to move a peg from the tee toward the cup, using a pair of randomizers of a first type, such as dice; determining the number of strokes to move a peg that has reached the green into the cup using a second type of randomizer, the second type of randomizer being a card, and counting strokes, the total strokes for a link being the sum of the number of occasions on which a player uses the first type of randomizers, the number of strokes indicated on the selected card and any penalties acquired while moving the peg from the tee to the cup.

20 Claims, 4 Drawing Sheets

52

| LAKESIDE FRONT NINE | | | | | | | | | | | |
|---|---|---|---|---|---|---|---|---|---|---|---|
| MAPLE | | | | | | | | | | | |
| HOLE | 1 | 2 | 3 | 4 | 5 | 6 | 7 | 8 | 9 | OUT | PAR |
| PAR | 4 | 4 | 5 | 3 | 4 | 4 | 5 | 3 | 5 | 37 | 37 |
| | | | | | | | | | | | |
| | | | | | | | | | | | |
| | | | | | | | | | | | |
| GAME | | | | | | | | | | | |
| | | | | | | | | | | | |
| | | | | | | | | | | | |
| | | | | | | | | | | | |
| GAME | | | | | | | | | | | POINTS |

| LAKESIDE BACK NINE | | | | | | | | | | | |
|---|---|---|---|---|---|---|---|---|---|---|---|
| OAK | | | | | | | | | | | |
| HOLE | 10 | 11 | 12 | 13 | 14 | 15 | 16 | 17 | 18 | IN | TOTAL |
| PAR | 5 | 3 | 4 | 3 | 5 | 3 | 5 | 4 | 4 | 36 | PAR 73 |
| | | | | | | | | | | | |
| | | | | | | | | | | | |
| | | | | | | | | | | | |
| GAME | | | | | | | | | | | |
| | | | | | | | | | | | |
| | | | | | | | | | | | |
| | | | | | | | | | | | |
| GAME | | | | | | | | | | | PAR 73 |

Fig. 4

GOLF BOARD GAME

FIELD OF THE INVENTION

The present invention relates to board games and more particularly board games simulating the game of golf.

BACKGROUND OF THE INVENTION

Board games have long been used as a mode of entertainment and socialization between friends. The time honored pastime of game playing has developed certain time parameters in which a game should be played, e.g. typically forty-five minutes to one hour for adults. Longer or shorter periods of time tend to detract from the enjoyment or ability to complete the game.

Board games have often simulated other forms of the same game. For instance, several patents have been issued to board games simulating the game of golf. Generally, these board game simulations attempt to bring various aspects of the outdoor version into the board game.

U.S. Pat. No. 4,042,246 (Standgard) discloses a board golf game, having a plurality of paths along which players move their respective pegs. Hazards such as trees, water, sand traps and the like are presented through, around, or over which a player attempts to guide their ball, e.g. peg. The ball is moved via a roll of die. Standgard includes steps such as requiring doubles to be rolled on the die to get out of a trap that typically take a long time to completed, but at least theoretically, can prevent the game from ever being completed, far exceeding the standard time allotted for board games.

U.S. Pat. No. 3,944,229 (Feeney) discloses a golf game, having pegs and peg holes. Die are rolled to determine the distance the ball, e.g. peg is moved toward the hole. The die are selected based upon the club selection to provide a more accurate feel of true golfing conditions, but adding to the complication and time of game play. Yardage between shots is to be added with prior shots on a given hole to determine the location of the ball, further adding to the complication. While these attributes purport to the actual feel of golf, the attributes focus a player on mathematics and figuring out which die, etc. should be used and detract from speedy play with socialization.

U.S. Patent Application Publication 2003/0025269 (Stranger) teaches a golf board game apparatus. This game includes a wide variety of pieces and is played on a traditional square-to-square path as is found in many board games. Use of die and cards move the ball forward and backward down each link. The excessive use of die and cards adds to the play time and changes the game from a social event to a storyline.

What is needed is a board game that simulates golf, is simplistic to play, avoids points that can stall the game and has a playtime that remains within the guidelines of board games. Desirably, the game should allow the socialization to flow as it does in standard golf, e.g. socialization may be impeded on the green, but otherwise socialization is not impeded with mathematical challenges, reading of cards and the like.

SUMMARY OF THE INVENTION

The present invention is a mechanically simple game, allowing the players a large amount of time to socialize. The game plays in a period of time between one-half and one hour, depending upon the number of players, which may range between two and four. The present game further emphasizes the highlights of the game of golf and avoids time consuming solutions to points of little interest.

A method of playing a board game is provided with the steps of providing a plurality of links each with a plurality of tracks, each track including peg holes extending from a tee to a cup, the cup positioned on a green, at least one of the tracks being directed through hazards and one of the tracks being directed along a fairway without hazards, each track bearing indica corresponding to a peg.

Each player selects a peg. The players take turns moving each player's respective peg. A player's peg may be moved in a couple of manners. In one manner, a player determines the number of holes to move a peg from the tee toward the cup, using a pair of randomizers of a first type, such as dice and moving such peg. In another manner, a player determines the number of strokes to move a peg that has reached the green into the cup using a second type of randomizer. The second type of randomizer may be a card.

Players may count their respect strokes. The total strokes for a link is the sum of the number of occasions on which a player uses the first type of randomizers, the number of strokes indicated on the selected card and any penalties acquired while moving the peg from the tee to the cup.

Advantageously, the present invention directs pegs along a track, avoiding calculations of wind speed and direction, slicing, hooking and other shot control issues.

As a further advantage, each player has an equivalent number of tracks that have hazards, e.g. sand traps, trees, water and out-of bounds, and an equivalent number of tracks devoid of hazards.

As yet another advantage, players are allowed to select whether they want to take a chance and attempt to chip the ball into the cup.

As still yet another advantage, players have the chance to obtain a hole in one shot on a par three hole.

Further, another advantage is that exact rolls to move the ball into the cup has been removed from the board game, reducing the play time and frustration from time delay.

These and other advantages will become clear from reading the following description with reference to the associated drawings.

DESCRIPTION OF THE DRAWINGS

FIG. 4 shows the score card.

DETAILED DESCRIPTION

Figure 1:
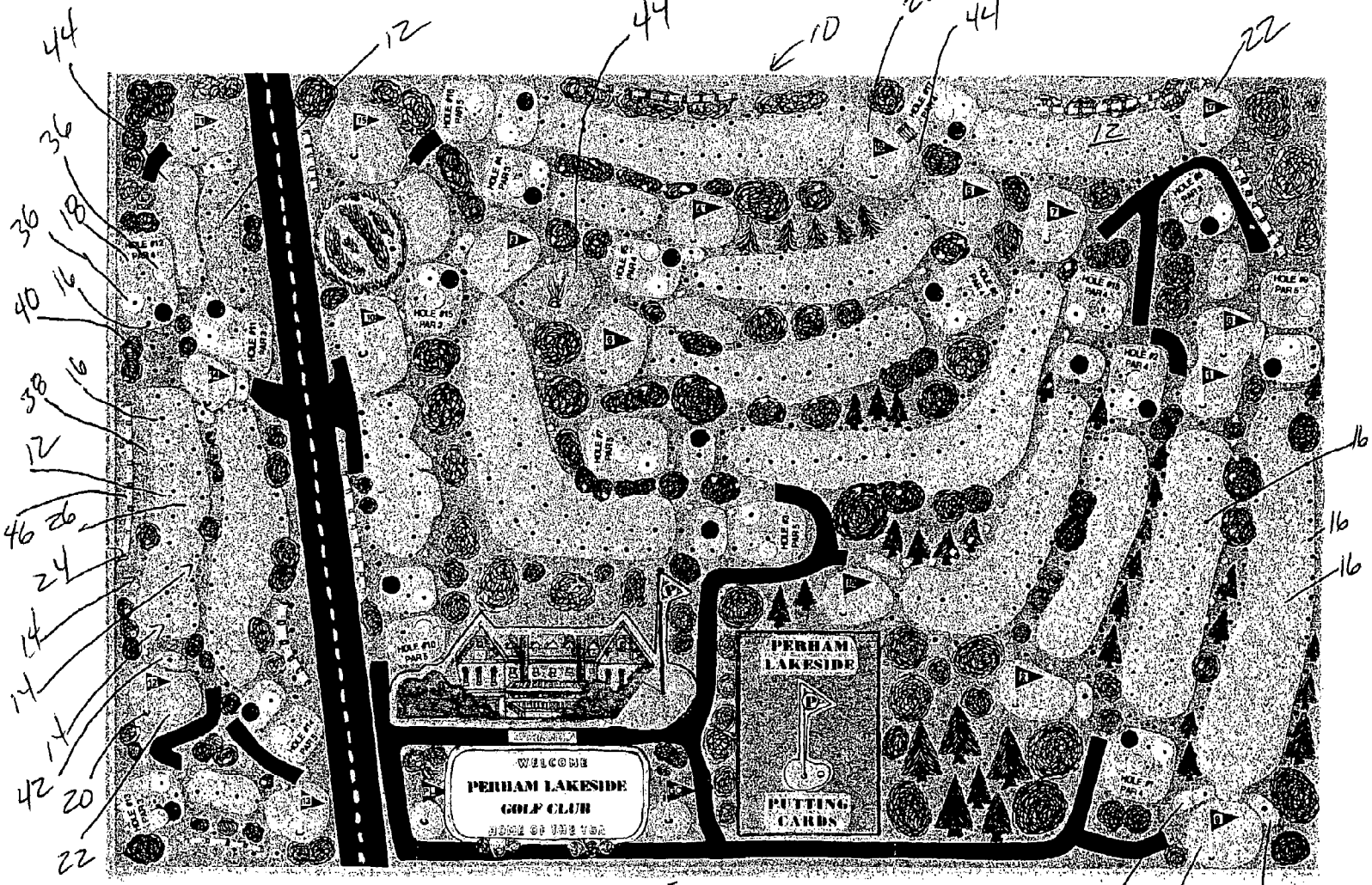
FIG. 1 is a reproduction of the game board.
Figure 2:
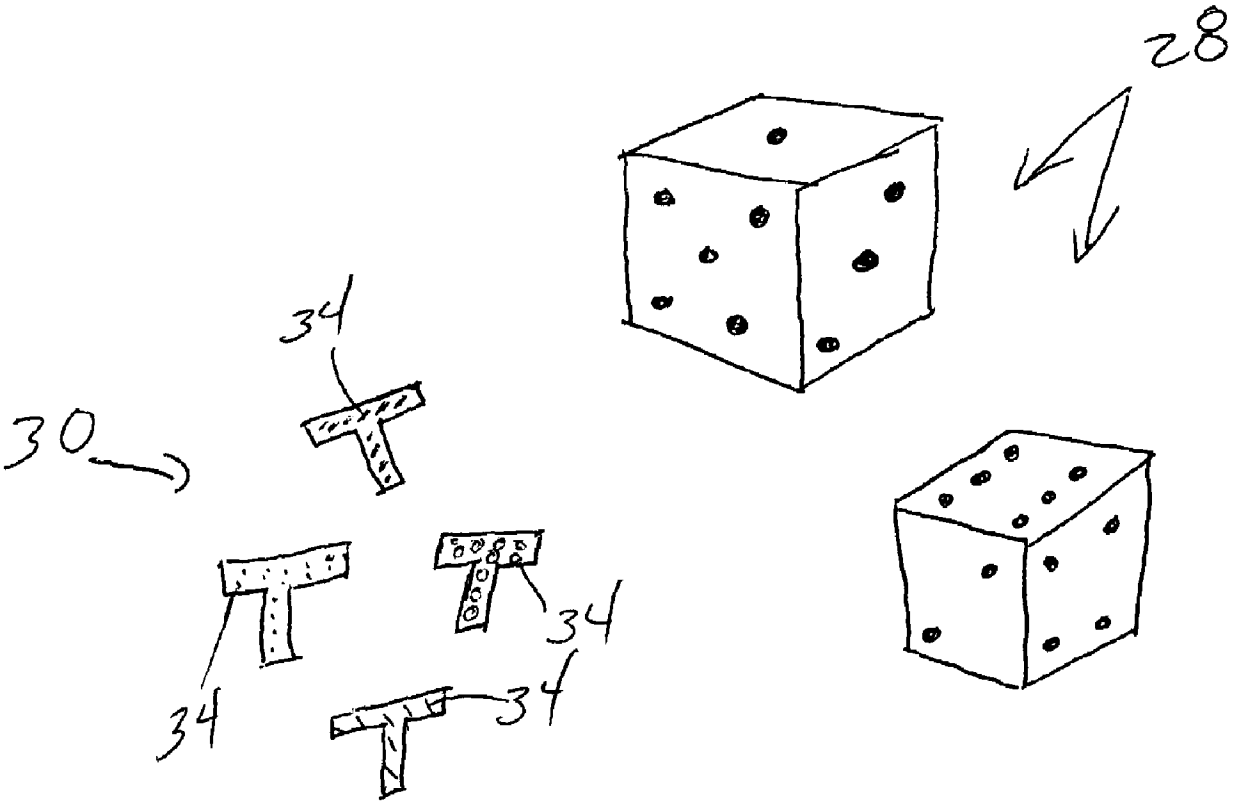
FIG. 2 shows the first type of randomizer and pegs.
Figure 3:
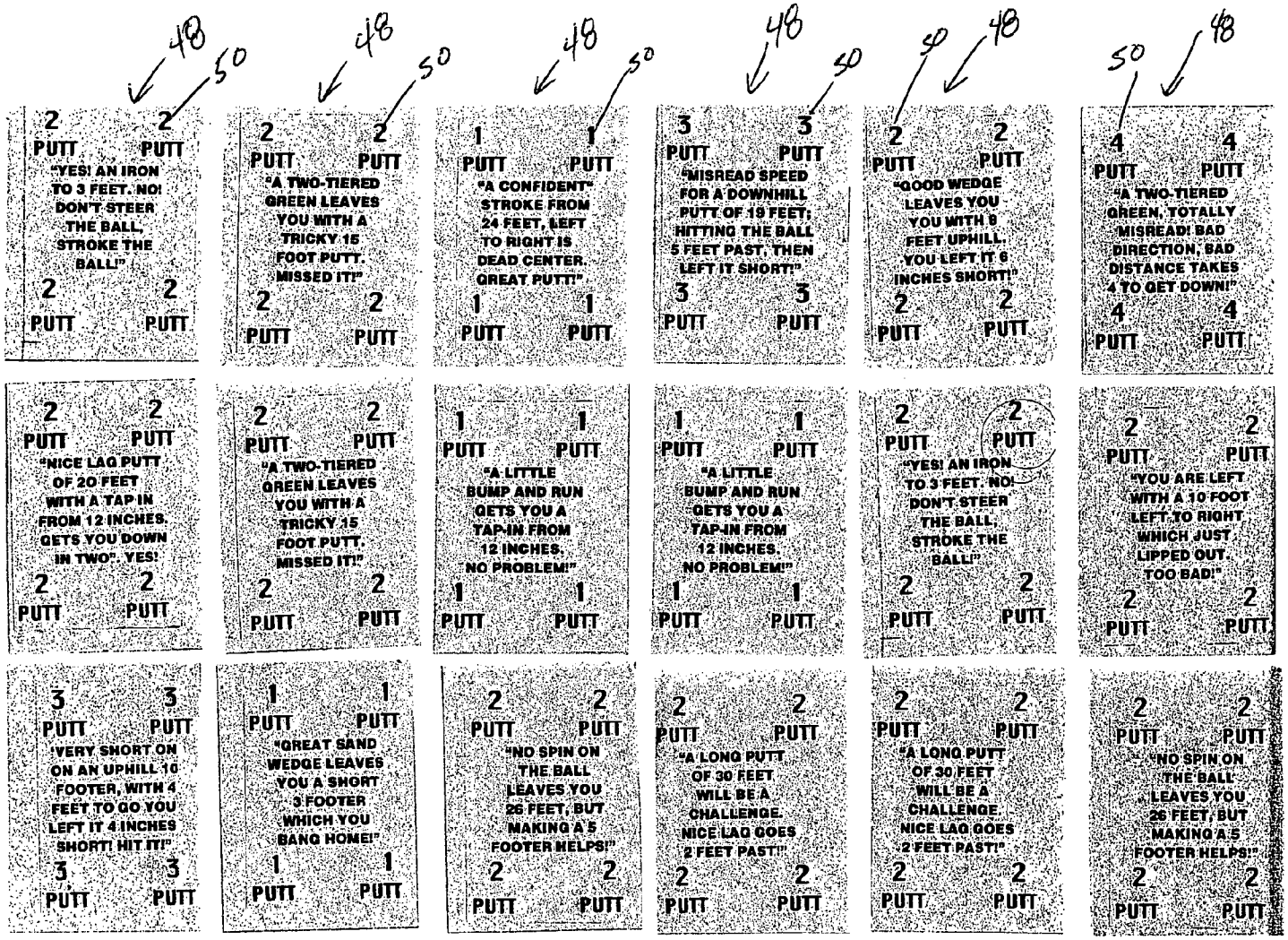
FIG. 3 shows the second type of randomizer.

The present invention is a method of playing a board game. The board game 10 may be provided with a plurality of links 12, perhaps numbered 1 through 18 such as found on a standard golf course. Each link 12 may be provided with a plurality of tracks 14 and each track 14 may include peg holes 16 extending from a tee 18 to a cup 20. Each link 12 may be designated par three, par four or par five depending upon the length of the track 14, e.g. number of peg holes 16 in the track 14. The cup 20 may be positioned on a green 22. At least one of the tracks 14 one each link 12 may be directed through hazards 24 and one of the tracks 14 may be directed along a fairway 26 without hazards 24. The game 10 may be arranged to rotate which player's peg 30 uses a track 14 through hazards 24 and which player's peg 24 uses a track 14 down the fairway 26 when starting a new link 12. A first type of randomizer 28 may be used to move a player's peg 30 from the tee 18 to the green 22 and a second type of randomizer 32 may be used to move the peg 30 from the green 22 into the cup 20.

Each player may select a peg 30. Each peg 30 may include indicia 34 corresponding to one of the tracks 14 on each link 12. Preferably, the indicia 34 is a color such as red, white, yellow and/or blue. The indicia 34 may be the color of the peg 30 and the start of each link 12, e.g. the tee 18, may have a ring 36 of the same color about the associated peg hole 16. The pegs 30 are sized to be received within the peg holes 16.

The players take turns moving their respective peg 30. A player's peg 30 may involve a variety of steps. A player determines the number of holes 16 to move their peg 30 from the tee 18 toward the cup 20, using a pair of randomizers 28 of the first type. Die are the preferred type of first randomizer 28 as die are generally mindless to operate and allow the player's to converse, while playing just as golfers do on a full sized course. The peg 30 is moved the number of holes 16, as indicated by the first type of randomizer 28, toward the cup 28.

After the first shot from the tee 18 a variety of situations may occur. On a par three link 12, the player may have scored a "hole-in-one", which occurs if the peg 30 reached the green 20 from the tee 18. The peg 30 may be on the fairway 26, in a hazard 24 or in the rough 38.

From the fairway 26 of rough 38, the player uses the first type of randomizer 28. Optionally, the player may using one randomizer 28 of the first type when there is the same number or less peg holes 16 between the player's peg 30 and the cup 20 than the highest achievable number on the randomizer 28. For instance, this option may be exercised if there are six or less peg holes 16 between the player's peg 30 and the cup 20 if the first type of randomizer 28 is a six-sided die. To exercise the option the player rolls one die and to not exercise the option the player rolls both die. If the first randomizer 28 indicates a move equal to or perhaps greater than the number of remaining peg holes 16, when this option is exercised, the player is determined to have "holed-out", e.g. "chipped-in". That is, the player has avoided counting strokes indicated on the second type of randomizer 32 when the player obtains an actual number on the first randomizer 28 of the first type that is equal to the number of remaining peg holes 16 between the peg 30 and the cup 20 if the player opts to use only one randomizer of the first type 28.

At least one of the tracks 14 on each link is directed through one or more hazards 24. Hazards 24 may include trees 40, sand traps 42, water 44, and out-of-bounds 46. From the trees 40 or sand traps 42, the play move their peg 30 using only one of the first type of randomizer 28 instead of a pair. From the water 44 and out-of-bounds 46, the player is assessed a penalty stroke and moves their peg 30 backward along their respective track 14 until the peg is out of the hazard 24 and then moves their peg 30 according to the rules for moving a peg 30 that is on the fairway 26 or in the rough 38.

A player's peg 30 is placed on the green 22 if a player obtains an equal or higher number on the randomizer of the first type 28 than the number of peg holes 14 between the peg 30 and the cup 20, assuming the player did not successfully exercise the option for "chipping-in" discussed above. On the green 22, a player determines the number of strokes to move their peg 30 from the green into the cup 20 using the second type of randomizer 32. Preferably, the second type of randomizer is a card 48 with an indicia 50 determining the number of putts.

After each link 12, each player counts and records their strokes. The total strokes for a link 12 is the sum of the number of occasions on which a player uses the first type of randomizers 28, the number of strokes indicated on the second type of randomizer 32, e.x., card 48, and any penalties strokes indicated by the link 12 and acquired while moving the peg 30 from the tee 18 to the cup 20, e.g. assessed strokes. The score for each link 12 may be recorded on a score card 52 and added to determine a game score. The lowest score is determined to be the winner.

Although the present invention has been described with reference to preferred embodiments, workers skilled in the art will recognize changes may be made in form and detail without departing from the spirit and scope of the invention. For instance, the game 10 may be of a generic course or modeled after an existing standard golf course. The scoring may be done in the form of best ball, skins, low score, and low total.

I claim:

1. A method of playing a board game comprising:

providing a plurality of links each with a plurality of tracks, each track including peg holes extending from a tee to a cup, the cup positioned on a green, at least one of the tracks being directed through hazards and one of the tracks being directed along a fairway without hazards;

each player selecting a peg, each peg having indicia corresponding to one of the tracks on each link;

taking turns moving each player's peg;

moving a player's peg, including the steps of:

determining the number of holes to move a peg from the tee toward the cup, using a pair of randomizers of a first type, such as dice and moving such peg; and determining the number of strokes to move a peg that has reached the green into the cup using a second type of randomizer, the second type of randomizer being a card; and counting strokes, the total strokes for a link being the sum of the number of occasions on which a player uses the first type of randomizers, the number of strokes indicated on the selected card and any penalties indicated by the link and acquired while moving the peg from the tee to the cup.

2. The method of claim 1 further comprising the step of indicating a par of each link selected from the group consisting of par three, par four and par five.

3. The method of claim 2 the wherein the strokes on a par three is counted as one if a player moves from the tee onto the green with one use of the pair of randomizers of the first type.

4. The method of claim 1 further comprising the step of:

optionally using one randomizer of the first type when there the same number or less peg holes between the player's peg and the cup than the highest achievable number on the randomizer; and avoiding counting strokes indicated on a card when a player obtains an actual number on the randomizer of the first type that is equal to the number of remaining peg holes between the peg and the cup if the player opts to use only one randomizer of the first type.

5. The method of claim 1 further comprising the step of:

rotating which player's peg uses a track through hazards and which uses a track down the fairway when starting a new link.

6. The method of claim 1 including the step of:

directing the tracks through hazards, such hazards including at least one member selected from the group consisting of trees, water, out-of-bounds, and sand traps.

7. The method of claim 6 further comprising the step of:

using one randomizer of the first type to move the peg if the peg lands in a peg hole marked with a tree hazard indicator.

8. The method of claim 6 further comprising the step of:

using only one randomizer of the first type to move the peg if the peg lands in a hole marked with a sand trap indicator.

9. The method of claim 6 further comprising the step of:

assessing a penalty stroke and moving a peg backward along the track out of an area indicated with a water hazard indicator when a player's peg lands on a water hazard indicator.

10. The method of claim 6 further comprising the step of:

assessing a penalty stroke and moving a peg backward along the track out of an area indicated with an out-of-bounds indicator when a player's peg lands on an out-of-bounds indicator.

11. A method of playing a board game comprising:

providing a plurality of links each with a plurality of tracks, each track including peg holes extending from a tee to a cup, the cup positioned on a green, at least one of the tracks being directed through hazards and one of the tracks being directed along a fairway without hazards;

each player selecting a peg, each peg bearing indicia corresponding to one track on each link;

indicating a par of each link selected from the group consisting of par three, par four and par five.

indicating the number of holes to move a peg from the tee toward the cup, using a pair of randomizers of a first type, such as dice;

determining the number of strokes to move a peg that has reached the green into the cup using a second type of randomizer, the second type of randomizer being a card; and counting strokes, the total strokes for a link being the sum of the number of occasions on which a player uses the first type of randomizers, the number of strokes indicated on the selected card and any penalties acquired while moving the peg from the tee to the cup, the total strokes being one if a player's peg moves from the tee onto the green with one use of the pair of randomizers of the first type.

12. The method of claim 11 further comprising the step of:

optionally using one randomizer of the first type when there the same number or less peg holes between the player's peg and the cup than the highest achievable number on the randomizer; and avoiding counting strokes indicated on a card when a player obtains an actual number on the randomizer of the first type that is equal to the number of remaining peg holes between the peg and the cup if the player opts to use only one randomizer of the first type.

13. The method of claim 11 further comprising the step of:

rotating which player's peg uses a track through hazards and which player's peg uses a track down the fairway when starting a new link.

14. The method of claim 11 including the step of:

directing the tracks through hazards, such hazards including at least one member selected from the group consisting of trees, water, out-of-bounds, and sand traps.

15. The method of claim 14 further comprising the step of:

using one randomizer of the first type to move the peg if the peg lands in a peg hole marked with a tree hazard indicator.

16. The method of claim 14 further comprising the step of:

using only one randomizer of the first type to move the peg if the peg lands in a hole marked with a sand trap indicator.

17. The method of claim 14 further comprising the step of:

assessing a penalty stroke and moving a peg backward along the track out of an area indicated with a water hazard indicator when a player's peg lands on a water hazard indicator.

18. The method of claim 14 further comprising the step of:

assessing a penalty stroke and moving a peg backward along the track out of an area indicated with an out-of-bounds indicator when a player's peg lands on an out-of-bounds indicator.

19. The method of claim 11 further comprising the step of:

placing the peg on the green if a player obtains an equal or higher number on the randomizer of the first type than the number of peg holes between the peg position and the cup.

20. A method of playing a board game comprising:

providing a plurality of links each with a plurality of tracks, each track including peg holes extending from a tee to a cup, the cup positioned on a green, at least one of the tracks being directed through hazards and one of the tracks being directed along a fairway without hazards, each track bearing indica corresponding to a peg;

each player selecting a peg;

determining the number of holes to move a peg from the tee toward the cup, using a pair of randomizers of a first type, such as dice;

optionally using one randomizer of the first type when there is the same number or less peg holes between the player's peg and the cup than the highest achievable number on the randomizer;

avoiding counting strokes indicated on a card when a player obtains an actual number on the randomizer of the first type that is equal to the number of remaining peg holes between the peg and the cup if the player opts to use only one randomizer of the first type;

determining the number of strokes to move a peg that has reached the green into the cup using a second type of randomizer if the player reaches the green using the first type of randomizers at lest two times to reach the green, the second type of randomizer being a card; and counting strokes, the total strokes for a link being the sum of the number of occasions on which a player uses the first type of randomizers, the number of strokes indicated on the selected card and any penalties acquired while moving the peg from the tee to the cup as indicated on the link.

* * * * *